United States Patent [19]

Colburn

[11] 3,994,801

[45] Nov. 30, 1976

[54] METHOD AND APPARATUS FOR SEPARATING MATERIAL

[75] Inventor: William A. Colburn, Denver, Colo.

[73] Assignee: Magnesep Corporation, Denver, Colo.

[22] Filed: Dec. 9, 1974

[21] Appl. No.: 530,666

[52] U.S. Cl. ..... 209/214; 209/223 R; 209/232

[51] Int. Cl.[2] ..... B03C 1/16

[58] Field of Search ..... 209/214, 223, 232, 218, 209/222; 210/222, 223

[56] References Cited

UNITED STATES PATENTS

| | | | |
|---|---|---|---|
| 673,172 | 4/1901 | McKnight | 209/218 |
| 1,391,400 | 9/1921 | Neuille | 209/218 X |
| 2.074,085 | 3/1937 | Frantz | 209/222 X |
| 2,954,122 | 9/1960 | Colburn | 210/222 X |
| 3,375,925 | 4/1968 | Carpenter | 209/223 R X |
| 3,690,454 | 9/1972 | Bekhtle | 209/223 R |

FOREIGN PATENTS OR APPLICATIONS

| | | | |
|---|---|---|---|
| 14,908 | 9/1962 | Japan | 209/218 |

*Primary Examiner*—Robert Halper
*Attorney, Agent, or Firm*—Wm. Griffith Edwards

[57] ABSTRACT

A method for magnetic separation of materials wherein the materials are ground to provide a mixture of fine particles of more- and less-magnetic materials which may include paramagnetic material and diamagnetic material. Discrete bodies of highly magnetizable material are introduced to a magnetic field of high intensity and thereby become a closely consolidated mass of bodies having interstitial pores extended through the mass in all directions. The mixed particles are caused to flow through the pores and the less-magnetic particles are separated from the more-magnetic particles and the mass of bodies in the magnetic field. The more-magnetic particles are separated from the bodies by moving the mass of bodies out of the magnetic field and by demagnetizing them so that they tumble freely and by washing or otherwise removing the particles from the bodies as they tumble after leaving the closely consolidated mass.

An apparatus suitable for the practice of the method includes an inclined passageway having the sides of a portion of said passageway formed by the poles of high-intensity magnets. A mass of spherical bodies of soft iron is moved progressively through the passageway by operation of a chain extending along the passageway and having lugs for dragging the bodies along down the incline. The mass of bodies fills the passageway cross section and within the magnetic field becomes a closely consolidated mass containing interstitial pores extending in all directions therethrough. A mixture of particles including more-magnetic and less-magnetic materials is caused to flow through the closely consolidated mass of magnetized bodies and the less-magnetic of diamagnetic materials are removed laterally through a foraminous area of the latter portion of the bottom of the passageway within the magnetic field. The mass of bodies is moved out of the field and the bodies become demagnetized and tumble downwardly along the passageway where magnetic or paramagnetic particles are washed from the bodies and are removed laterally through a suitable grill of foraminous bottom wall of the passage and are collected while the then-cleaned bodies are returned to the upper end of the passage for reuse.

19 Claims, 7 Drawing Figures

METHOD AND APPARATUS FOR SEPARATING MATERIAL

This invention relates to the magnetic separation of materials and particularly to an improved method and apparatus for effecting the separation of more-magnetic materials from less-magnetic materials.

This invention is an improvement on the invention of my U.S. Pat. No. 2,954,122 issued on Sept. 27, 1960.

Throughout this specification the terms "more magnetic" and "less magnetic" are used to designate materials having higher and lower magnetic susceptibilities, respectively.

Many materials may be separated from one another on the basis of differences in their magnetic properties. Thus magnetic separators may be employed, for example, to separate magnetic particles from a mass of non-magnetic materials. Magnetic separators are employed widely in the mining industry, some being adapted for use in dry pulverized ore and others in wet ground ore or slurry. In general these separators will separate more-magnetic materials from less-magnetic materials; however, when the more-magnetic materials are only weakly magnetic or when the materials are very finely divided, the force exerted by the magnetic field of these separators often is not sufficient to remove the more-magnetic material effectively. This difficulty arises because the magnetic forces are not sufficiently strong to force the more-magnetic materials through the mass of material so that the particles of magnetic material can reach the magnetic pole or collector; and, in most types of commercial separators, this difficulty is further increased because the more-magnetic materials must be drawn through the mass of material in directions transverse to the direction of flow or movement of the mass of material. Present day commercial magnetic separators are highly effective for separating ferromagnetic materials from non-magnetic materials; however, they are not entirely satisfactory for separating and collecting weakly magnetic materials. By way of example, the present commercial separators are relatively inefficient when employed to separate weakly magnetic tungsten minerals from the rock in which they occur. The method and apparatus of my above mentioned patent overcomes disadvantages of the commercial separators and it is desirable to provide more highly efficient use of the teachings of that patent.

Acccordingly, it is an object of the present invention to provide an improved method for separating weakly magnetic materials from non-magnetic materials.

It is another object of this invention to provide an improved method for treating a mass of finely divided materials to separate the more-magnetic material from the less-magnetic material in the mass.

It is another object of this invention to provide an improved method for treating a mass of finely divided materials to separate the ferromagnetic and paramagnetic materials from the diamagnetic materials in the mass.

It is a further object of this invention to provide an improved apparatus for separating more-magnetic materials from less-magnetic materials.

It is a further object of this invention to provide an improved apparatus for separating paramagnetic materials from diamagnetic materials.

Briefly, in carrying out the objects of this invention in one form of the method thereof, an intense magnetic field is provided and a mass of highly magnetizable soft iron bodies is moved into the field where it becomes a closely consolidated mass having interstitial pores extending in all directions therethrough. The material to be treated is supplied in a slurry of a mixture of finely divided less-magnetic and more-magnetic materials to be separated and is then passed through the pores of the closely consolidated mass; the more-magnetic materials are attracted to the magnetized bodies and the less-magnetic materials are allowed to flow transversely downward out of the consolidated mass. The closely consolidated mass is moved through the field and on leaving the field is demagnetized; when soft iron is used the bodies become demagnetized upon leaving the magnetic field. The bodies then tumble freely and the more-magnetic materials are washed from the bodies and collected. The bodies are returned for reuse. The size or sizes of the magnetizable bodies are selected so that the pores formed in the consolidated mass will afford ready passage of the particles of the material in the slurry and will provide close proximity between the iron bodies and the mixture being treated.

The apparatus employed as illustrated by one embodiment thereof comprises a downwardly sloping passage and a series of strong electromagnets, each having its poles on opposite sides of the passage to produce an intense unidirectional field across the passage. A mass of free bodies of highly magnetizable material is supplied to the upper end of the passage and, on entering the magnetic field portion of the passage wherein the poles of the magnets form the walls of the passage, becomes a part of a closely consolidated mass of bodies. The closely consolidated mass is moved through the passage by a chain having projections for engaging the mass. A slurry of finely divided materials to be separated is introduced to the upper end of the passage and flows through the spaces between the bodies forming the closely consolidated mass. A grating or foraminous area of the bottom wall of the latter portion of the passage allows the less-magnetic materials to flow out of the passage and be collected below the passage while the more-magnetic materials cling to the magnetized bodies and continue through the passage with the mass of magnetized bodies. On leaving the magnetic field, the bodies are released into a channel and are demagnetized. A washer or spray is provided to remove the materials from the bodies as they tumble freely after being demagnetized. A second foraminous area of the bottom wall is provided to remove the materials washed from the bodies. A return system receives the demagnetized bodies and returns them to the upper end of the passage for continuous operation of the separator. The method of this invention may similarly be applied to dry pulverized ore and to gases. The method is well suited to a wide range of applications, for example, for removing small amounts of undesirable more-magnetic materials from the bulk of a mixture such as iron contamination from water or iron minerals from clay minerals. Similarly, it can be applied to reducing small amounts of non-magnetic materials from a predominantly magnetic mixture. For example, silica and other less-magnetic material can be separated from iron ores.

The features of novelty which characterize this invention will be pointed out with particularity in the appended claims. The invention itself, however, both as to the method for treating finely divided material and as to the organization and arrangement of the apparatus embodying the invention, together with further objects and advantages thereof, may best be understood upon reference to the following description taken in connection with the accompanying drawings in which:

Figure 1:
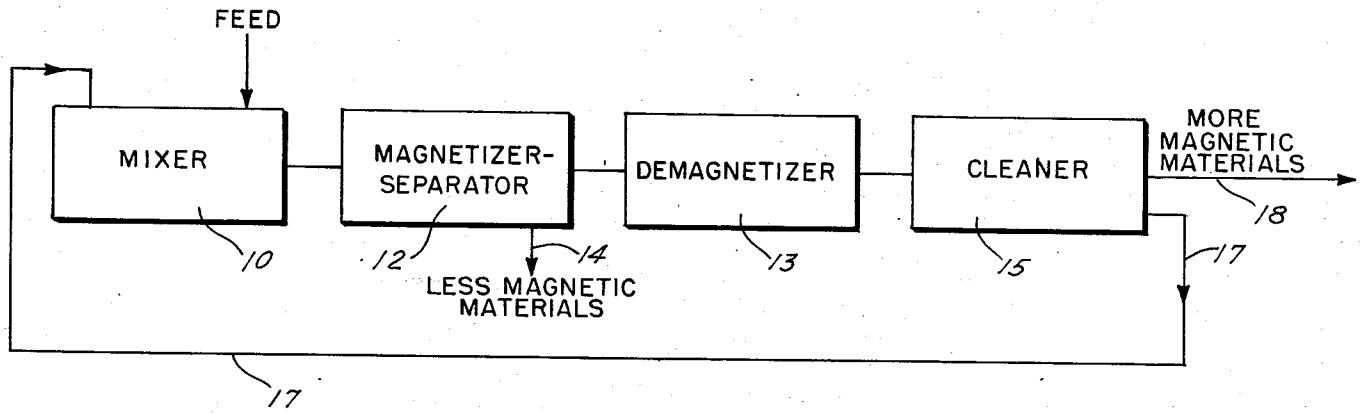
FIG. 1 is a block diagram or flow sheet illustrating the process of the invention.

Referring now to the drawings, the several steps in the process of the present invention are indicated in FIG. 1, the block diagram. In carrying out the process, a finely divided ore or other material containing more-magnetic and less-magnetic materials from which it is desired to remove the more-magnetic material is supplied to a mixing apparatus indicated at 10. The feed may be wet, dry or gaseous, depending upon the materials to be handled and the apparatus available. The mixer 10 may be a hopper into which the feed and the relatively large bodies of highly magnetizable materials such as soft iron spheres are poured. The relatively large highly magnetizable bodies are moved through an inclined channel through the magnetizer-separator 12 in which they become magnetized. The feed flows through the interstitial spaces or pores between the larger bodies within the magnetic field. Part way through the magnetizer-separator, the less-magnetic materials are allowed to move out of the pores between the larger bodies by means of screens or grills through outlet 14. Within the magnetizer-separator 12 the more-magnetic materials are attracted to the larger magnetized bodies and held thereto until the larger bodies are removed from the magnetic field and become demagnetized in the demagnetizer 13. Under some conditions, particularly for example, when the larger bodies are of soft iron, the larger bodies become demagnetized when they are removed from the magnetic field. For separating some materials it may be found unnecessary to employ a demagnetizing coil before passing the bodies to the cleaning apparatus. After the magnetic bodies are demagnetized, they are passed to the cleaner 15 where they are released and allowed to tumble freely and become washed. The cleaner 15 may be of any suitable type. For example, a screen and washing spray may be employed when the process is a wet process and a blower and dust collector may be employed in the dry process. The return circuit 17 for the magnetizable bodies may be of any suitable construction. For example, it may be a continuous belt, a chain-and bucket device or a pump. Regardless of the apparatus employed the essential feature of the process of this invention is the distribution of magnetic poles throughout the mass of material to be treated so that none of the material is required to travel any substantial distance in order to reach a magnetic pole and to be separated from the other material. A further feature of this invention is the gathering region wherein the more-magnetic materials are allowed to leave the mass. A further feature of this method is that the less-magnetic materials are separated from the mixture while the bodies are within the magnetizing field to minimize the loss of any of the weaker of the more-magnetic materials. A further feature of this method is that the highly magnetizable larger bodies complete a very-high-magnetic-permeability path for the magnetic flux so that the same magnetizing energy can produce higher magnetic flux densities than could be realized if there were a gap in the high-magnetic-permeability path such, for example, as would be introduced by a container having side walls interposed between the mass and the surfaces of the poles. A further feature of this method is that each of the larger highly magnetizable bodies becomes a magnet while it is in the magnetic field and at the point of contact between individual bodies, the magnetic field gradient is very large with a result that diamagnetic particles are forced away from the points of contact, whereas the paramagnetic materials and the ferromagnetic materials are attracted toward the points of contact between the bodies with a resulting high efficiency of separation. A further feature of this invention is that the larger bodies are released from the magnetically bonded closely consolidated mass of bodies and are allowed to tumble in the cleaner so that the more-magnetic material may be cleaned efficiently from the larger bodies. After being removed from the tumbling bodies the more-magnetic material is discharged through an outlet duct 18. This method has been found effective for removing relatively weak magnetic materials from a mass of less-magnetic materials and, for example, has been found suitable for removing tungsten minerals from the rock in which they occur.

Figure 3:
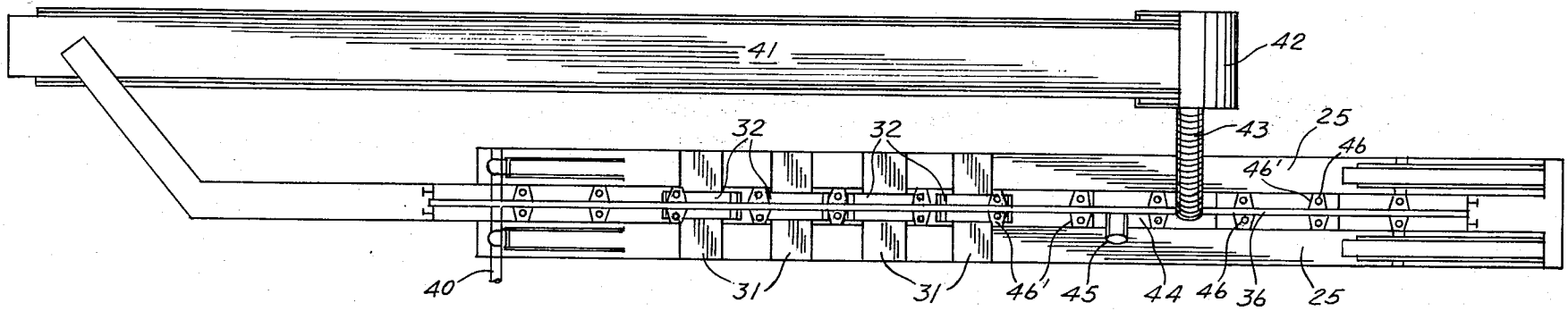
FIG. 3 is an auxiliary projection view on a plane parallel to the inclined frame of the apparatus of FIG. 2.
Figure 2:
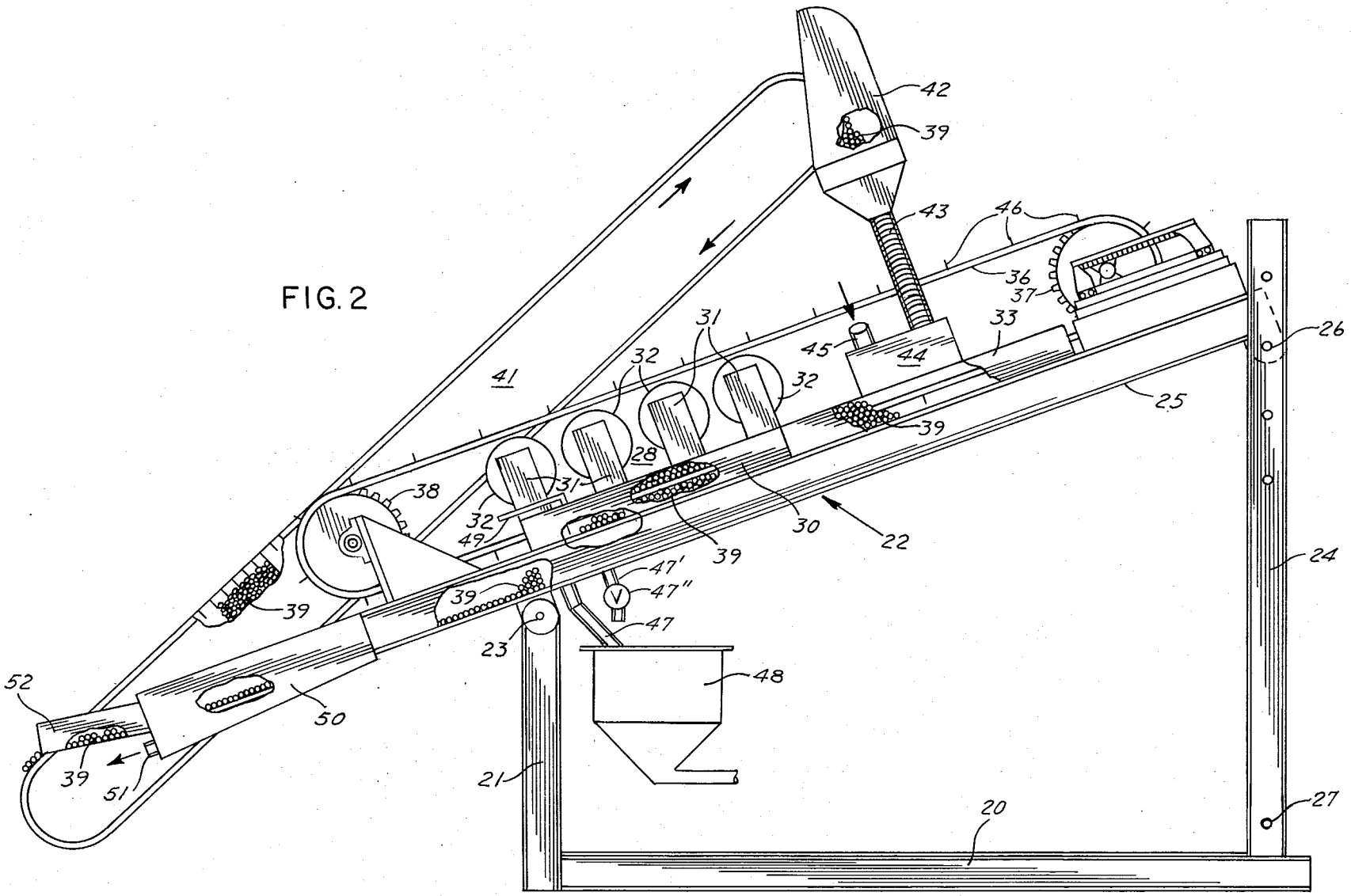
FIG. 2 is a somewhat diagrammatic side elevation view of a magnetic separation apparatus embodying the invention.
Figure 4:
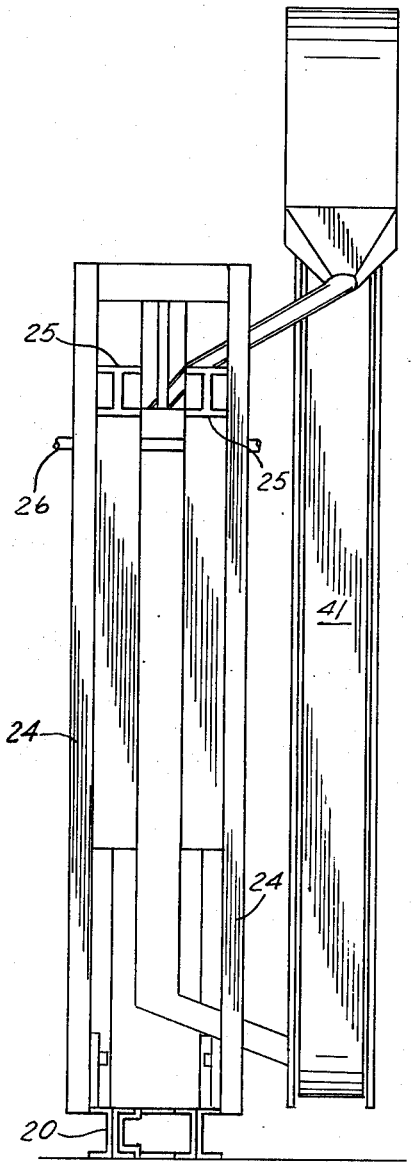
FIG. 4 is a right hand elevation view of the apparatus of FIG. 2.
Figure 5:
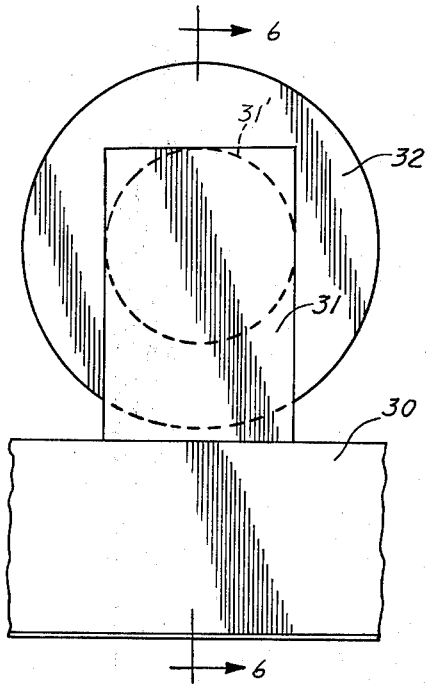
FIG. 5 is an enlarged side elevation view of a portion of the apparatus.

The apparatus illustrated in FIGS. 2, 3 and 4 is one embodiment of the invention suitable for the practice of the method of the invention. The apparatus shown in these figures of the drawing provides a system employing a wet process for removing more-magnetic material from a slurry containing a mixture of finely ground or milled more-magnetic and less-magnetic materials.

As shown in FIG. 2 the apparatus comprises a base 20 having an upright support 21 to which an inclined structure 22 is pivoted at 23. An upright frame 24 is pivoted to the base 20 at its right hand end. The inclined structure 22 includes side members 25 which are anchored to the frame 24 at selected positions shown, for example, as four holes to which the end of the frame may be attached, it being shown attached at the next-to-highest position by a rod 26 extending across the frame as shown in FIG. 4. The slope of the structure may thus be adjusted by connecting the beams 25 at different ones of the holes in the upright 24. The upright 24 is pivoted to the base 20 at 27 to allow the setting of the beams 25 at any one of the positions.

An electromagnet assembly 28 is mounted on the beams 25 and comprises bars 30 providing opposite pole pieces for four electromagnets. Each magnet comprises a U-shaped highly permeable iron path provided by side members 31 and a connecting cylindrical member 31' and an energizing winding 32 mounted about the member 31', the ends of the U being of the same width as the pole pieces 30. When the windings 32 are energized, an intense magnetic field is produced between the pole pieces 30.

Figure 6:
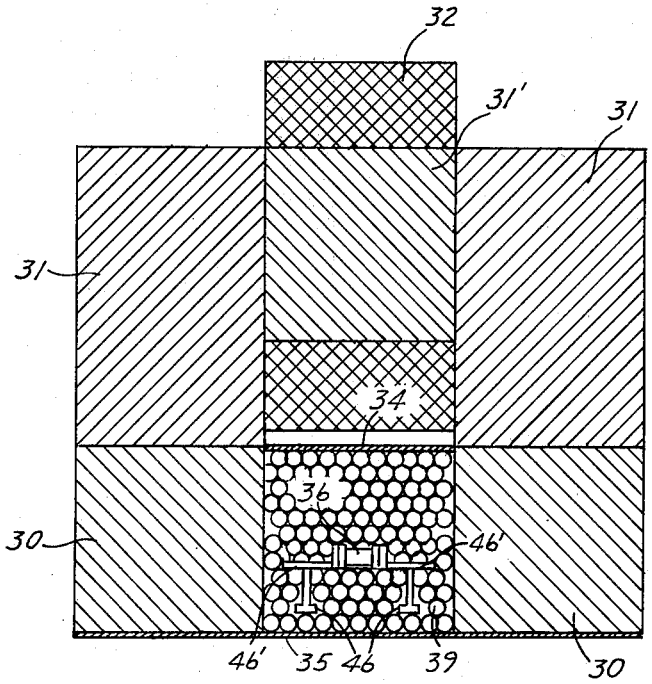
FIG. 6 is a sectional view taken along the line 6—6 on FIG. 5.

A duct or conduit 33 is mounted on the beams 25 in alignment with the gap between the pole pieces 30 and top and bottom walls 34 and 35 are provided between the pole pieces to provide a continuation of the passageway through the duct 33. This construction is shown in cross section view in FIG. 6.

A chain 36 mounted on sprockets 37 and 38 is arranged to move downwardly through the center of the duct and passageway between the poles 30. The chain is driven by a motor unit (not shown) connected to drive the chain through a shaft 40. A supply of bodies 39 of soft iron or other easily magnetizable material is provided, and these are circulated through the duct and move downwardly along the incline after leaving the magnetic field and are returned for recirculation by a conveyor 41 driven by a suitable motor (not shown). At the upper end of the conveyor, the magnetizable bodies are delivered to a hopper 42 from which they are delivered through a supply tube 43 to a mixing chamber 44. A slurry of mixed more-magnetic and less-magnetic materials in fine particulate state is delivered to the chamber 44 through an inlet 45. The chamber 44 is in open communication with the duct 33 and the mixture of slurry and magnetizable bodies is delivered to the duct and moves into the zone between the magnetic poles 30. When the bodies enter the magnetic field they are bonded together in a mass which is in effect closely and firmly consolidated and fills the duct between the poles 30 and surrounds the chain 36. The chain is provided with lugs or fingers 46 attached to the chain on lateral projections 46' which engage the consolidated mass of bodies and move it progressively through the magnetic zone.

The bodies when in the closely consolidated mass form interstitial spaces which constitute pores extending through the mass in all directions. The bodies are preferably of spherical configuration selected to provide adequate pores for conducting the particles of the material in the slurry. The slope or inclination of the duct is adjusted to provide the desired rate of flow of the slurry, and the speed of the chain is adjusted to provide the desired rate of movement of the closely consolidated mass of magnetic bodies through the duct. The magnetic bodies forming the closely consolidated mass are held tightly together by the magnetic field and complete a high-magnetic-permeability path for the magnetic flux.

The slurry is free to flow through the pore spaces at a rate determined by such factors as the angle of inclination of the duct, the size of the magnetized spheres, the viscosity of the slurry, and the amount of magnetic material present in the slurry.

The floor of the duct between the pole pieces is foraminous in the lower portion of the magnetic field zone and may be of suitable grill construction to allow passage of the less-magnetic or non-magnetic particles with the slurry and out laterally through the pores of the consolidated mass of bodies and through an outlet 47 to collecting unit such as a hopper 48 where the material may be separated from the liquid of the slurry. For some applications it may be desirable to introduce wash water at the lower end of the magnetic field through a supply pipe 49 to reduce the amount of less-magnetic material which may be carried mechanically by the spheres or bodies and the more-magnetic material; a separator outlet 47' is provided in that case so that the non-magnetic fraction can pass out of duct 47' and the wash water will pass out through duct 47. A valve 47'' in the duct 47' is closed when wash water is not being used.

When the closely consolidated mass of bodies reaches the end of the duct between the magnetic poles and moves out of the magnetic field the soft iron bodies become demagnetized and fall downwardly into a conduit mounted between the beams 25 and are free to tumble downwardly along the incline toward a cleaner 50 where the magnetic or paramagnetic materials are washed or otherwise separated from the bodies and are delivered through an outlet 51 to be collected. The bodies move out of the cleaner 50 through a chute 52 and are delivered to the conveyor 41 for return to the hopper 42. The apparatus may thus be employed for continuous operation.

Figure 7:
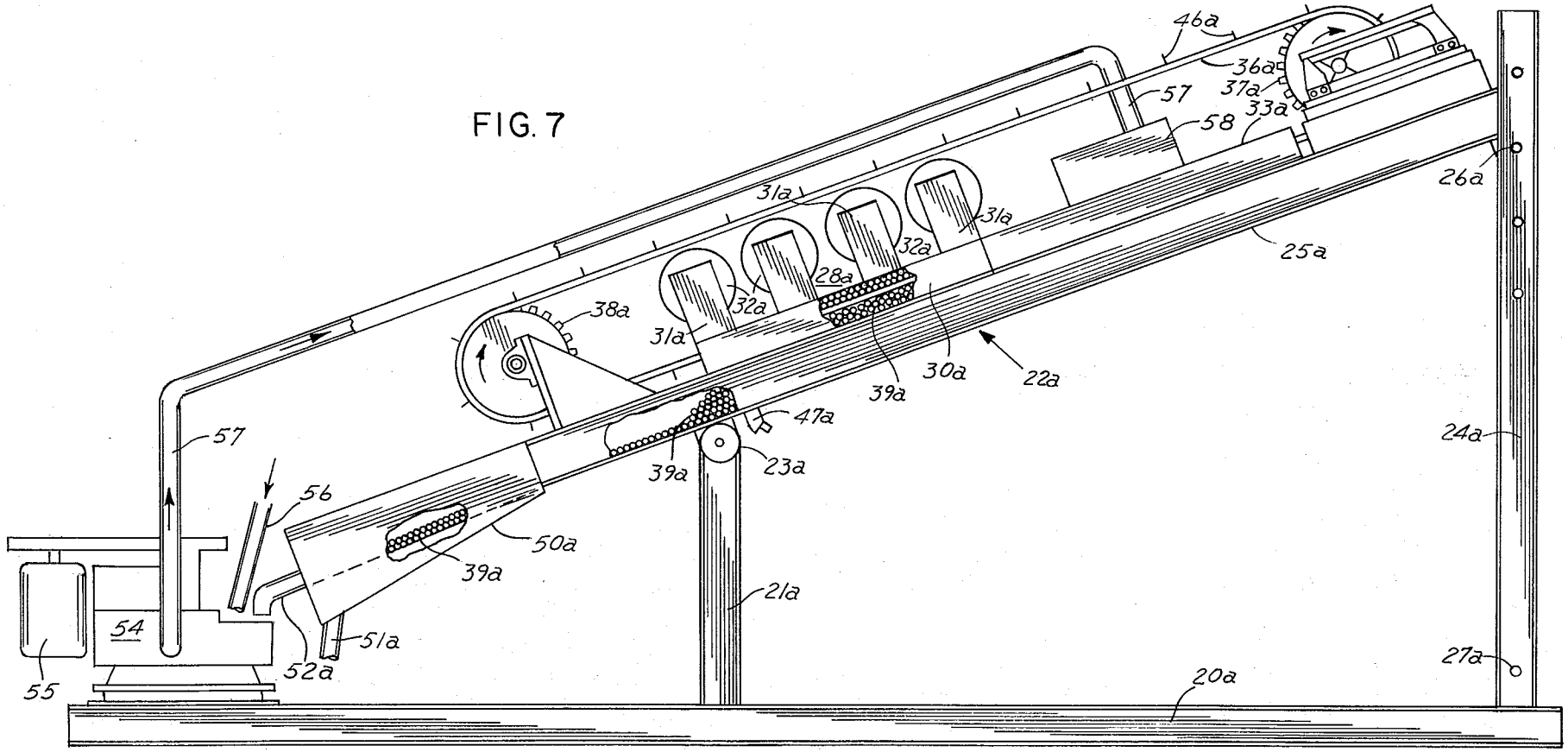
FIG. 7 is a somewhat diagrammatic side elevation view illustrating another embodiment of the invention.

The embodiment of the invention illustrated in FIG. 7 is essentially similar to that of FIG. 2 and corresponding parts have been designated by the same numerals with the suffix letter a. This embodiment differs from that of FIG. 2 in that the slurry to be treated and the spherical magnetizable bodies are delivered to a pump 54 driven by a motor 55. The slurry is delivered to the pump by a supply pipe 56 and the spherical bodies are delivered by discharge from the outlet **52*a* of the cleaner 50*a*. The slurry and spherical bodies are mixed in the pump intake and delivered by the pump through a pipe 57 which conveys the mixture to a chamber 58 corresponding to the chamber 44 of FIG. 2. This provides an effective and efficient return of the spherical bodies and a thorough mixing of the slurry in the bodies before the mixture is delivered to the duct 33*a*.**

Soft iron spheres have been found to be usable over substantial periods of time without objectionable wear and are desirable for the present process because of the ease of demagnetizing them by simple withdrawal from the magnetic field. However, for some applications it may be desirable to use a material harder than soft iron for the spherical bodies. Harder magnetic materials in general have greater magnetic retentivity, and for effective operation require demagnetization by an alternating field such as referred to in the above patent. Demagnetization in this manner is well known in the art. Such demagnetizer would be located adjacent the discharge end of the magnetic zone as indicated at 13 in FIG. 1.

The method of this invention has been found highly effective for the separation of paramagnetic materials from less-magnetic or diamagnetic materials, as well as for the separation of ferromagnetic materials from paramagnetic materials. In the practice of the invention the strength of the magnetic field may be adjusted or varied depending upon the magnetic characteristics of the materials to be treated. For example, the separation of paramagnetic materials from less-magnetic materials may require a substantially stronger magnetic field than is required for the separation of ferromagnetic materials from less-magnetic materials.

By way of illustration, and not be way of limitation, a magnetic separation apparatus embodying the present invention was built and operated and tested with a variety of different ores. In the test of one particular ore, the tailings from a plant operated in accordance with present day practice were passed through the apparatus. The apparatus was operated at a rate of 6 tons per hour with 9 kilowatts of power supplied to the electromagnets. The drag chain corresponding to the chain 36 of FIG. 2 was operated at a rate of one-half foot per second at four horsepower. The inclination of the duct 33 was set at 30° to the horizontal.

In the course of present day practice for the separation of the aforesaid particular tungsten ore, approximately one-third of the tungsten is lost because the grinding is not sufficiently fine to provide mineral liberation. Furthermore, much of the tungsten is also being lost in the minus 400-mesh fraction. However, finer grinding would increase the amount of tungsten lost in the fine fraction and would increase costs.

In the test employing the tailings from the treatment plant for the aforesaid particular ore, over 60% of the tungsten was recovered.

While the invention has been described in connection with specific arrangements of apparatus, various other applications and modifications will occur to those skilled in the art. Therefore it is not desired that the invention be limited to the use of the specific apparatus disclosed and it is intended by the appended claims to cover all forms and modifications which lie within the spirit and scope of the invention.

I claim:

1. The method of separating particles having higher magnetic susceptibilities from a mixture of particles having higher and lower magnetic susceptibilities which comprises:

providing a pair of smooth faced magnetic pole pieces facing each other in spaced relationship;

providing an intense magnetic field between said pole pieces;

providing a quantity of discrete bodies of highly magnetizable material and moving the bodies into the magnetic field to form a closely consolidated mass of bodies in engagement with one another and with the faces of the pole pieces to complete very high-magnetic-permeability paths between the pole pieces and to produce very large magnetic field gradients at the points of engagement between the bodies, the closely consolidated mass of bodies having interstitial pores extending therethrough in all directions;

moving the mass of bodies along a predetermined path and through the magnetic field between the poles while in engagement with the pole faces;

passing a mixture of particles having higher and lower magnetic susceptibilities through the pores of the closely consolidated mass of bodies along the path of movement of the mass of bodies whereby the particles having the higher magnetic susceptibilities are attracted to the bodies;

allowing the particles having lower magnetic susceptibilities to flow transversely of the path of movement and out of the closely consolidated mass of bodies while said bodies are under the influence of the intense magnetic field and removing the particles having lower magnetic susceptibilities removing the closely consolidated mass of bodies from the magnetic field and demagnetizing the bodies and allowing them to tumble freely; and, removing the particles having higher magnetic susceptibilities from the tumbling bodies and collecting the particles having higher magnetic susceptibilities.

2. The method of claim 1 wherein the path of movement of the mass of bodies through the magnetic field is a straight path.

3. The invention of claim 2 wherein the straight path is downwardly inclined and including the step of adding the mixed particles in a liquid slurry to the upper end of the path for affording a passage of the slurry downwardly through the closely consolidated mass of bodies.

4. The invention of claim 3 wherein the removing of the particles having higher magnetic susceptibilities from the tumbling bodies is effected by washing the bodies with fluid while they are tumbling.

5. The invention of claim 4 including the step of providing a washing fluid for the bodies after the carrying fluid has been separated from the bodies but while the bodies are still within the intense magnetic field.

6. The invention of claim 1 wherein said mixture of more- and less-magnetic particles is supplied to and carried through the pores of the consolidated mass of bodies by a fluid.

7. The invention of claim 6 including the step of providing a washing fluid for the bodies after the carrying fluid has been separated from the bodies but while the bodies are still within the intense magnetic field.

8. The invention of claim 1 wherein said bodies are provided in spherical form and of soft iron whereby they become demagnetized upon passing out of the magnetic field.

9. The invention of claim 8 wherein the removing of the particles having higher magnetic susceptibilities from the tumbling bodies is effected by washing the bodies with fluid while they are tumbling.

10. The invention of claim 9 including the step of providing a washing fluid for the bodies after the carrying fluid has been separated from the bodies but while the bodies are still within the intense magnetic field.

11. The invention of claim 1 wherein the removing of the particles having higher magnetic susceptibilities from the tumbling bodies is effected by washing the bodies with fluid while they are tumbling.

12. The invention of claim 1 including the step of providing a washing fluid for the bodies after the carrying fluid has been separated from the bodies but while the bodies are still within the intense magnetic field.

13. An apparatus for separating materials having higher magnetic susceptibilities from a mixture of materials having higher and lower magnetic susceptibilities comprising:

means providing a passageway;

means including a pair of magnetic poles having smooth faces forming portions of the walls of said passageway for producing a magnetic field across a portion of said passageway;

a quantity of discrete bodies of highly magnetizable material;

means for supplying said bodies to said passageway whereby upon entering said magnetic field they form a closely consolidated mass of bodies engaging said pole faces and each other and having interstitial pores extending through said mass in all directions, the engagement of said bodies and said pole faces providing very low reluctance paths for the magnetic flux between said pole pieces;

means for supplying to said passageway a fluid carrying a mixture of particles having higher and lower magnetic susceptibilities whereby said fluid with the mixture therein flows through said pores and the material having the higher magnetic susceptibility is attracted to said bodies in said mass within the magnetic field;

means for affording a flow of the materials having lower magnetic susceptibilities transversely of said passageway for removing the materials having lower magnetic susceptibilities from said mass and said passageway;

means for removing said bodies from said passageway, said bodies being demagnetized on leaving the magnetic field and tumbling freely; and, means for removing the material having higher magnetic susceptibilities from said bodies during tumbling.

14. The apparatus of claim 13 including means for forcibly moving said mass of bodies through said portion of said passageway.

15. The apparatus of claim 14 wherein said means for forcibly moving said mass of bodies comprises an endless chain having one portion arranged to move downwardly through said passageway and lugs on said chain for engaging said bodies.

16. The apparatus of claim 14 including means for discharging a first stream of fluid and material having lower magnetic susceptibilities from said consolidated mass of bodies within the magnetic field, and means for supplying additional fluid to said mass near the end of the magnetic field and means for discharging a second stream of fluid containing material having lower magnetic susceptibility from said passageway.

17. The apparatus of claim 13 including means for collecting the tumbling bodies and for returning them to said supplying means.

18. The apparatus of claim 13 wherein said passageway is inclined downwardly and affords the flow of said fluid by gravity therethrough.

19. An apparatus for separating materials having higher magnetic susceptibilities from a mixture of materials having higher and lower magnetic susceptibilities which comprises:

means providing a downwardly inclined passageway;

a quantity of discrete highly magnetizable bodies;

means including a pair of magnetic poles having smooth faces forming portions of the walls of said passageway for producing a magnetic field across a portion of the passageway;

means for supplying said bodies to said passageway for forming a closely consolidated mass of bodies in said portion of said passageway;

means for moving said consolidated mass through said portion in frictional engagement with said pole faces, said bodies being demagnetized upon leaving said portion;

means for supplying a fluid carrying a mixture of materials having higher and lower magnetic susceptibilities to said mass for producing a flow of fluid through the pores in said mass;

means for removing fluid and material having lower magnetic susceptibility transversely of said passageway and from said mass in said portion of said passageway; and, means for removing fluid and material having higher magnetic susceptibility from said bodies upon their being demagnetized.

* * * * *